United States Patent [19]

Schilling et al.

[11] Patent Number: 4,558,654

[45] Date of Patent: Dec. 17, 1985

[54] UNDER BED THREAD TRIMMER WITH THREAD DETECTOR STOP MOTION

[75] Inventors: Lothar Schilling, Kaiserslautern; Karl H. Schiller, Rockenhausen, both of Fed. Rep. of Germany

[73] Assignee: Pfaff Industriemaschinen GmbH, Fed. Rep. of Germany

[21] Appl. No.: 657,340

[22] Filed: Oct. 3, 1984

[30] Foreign Application Priority Data

Oct. 10, 1983 [DE] Fed. Rep. of Germany ... 8329216[U]

[51] Int. Cl.[4] ..... D05B 51/00

[52] U.S. Cl. ..... 112/298; 112/273; 112/275; 112/300

[58] Field of Search ..... 112/298, 300, 275, 277, 112/278, 273

[56] References Cited

U.S. PATENT DOCUMENTS

| | | | |
|---|---|---|---|
| 3,658,021 | 4/1972 | Hedegaard et al. | 112/298 X |
| 4,284,020 | 8/1981 | Conner, Jr. et al. | 112/273 |
| 4,429,651 | 2/1984 | Tajima | 112/273 |
| 4,469,038 | 9/1984 | Fujikawa | 112/277 |

FOREIGN PATENT DOCUMENTS 3029782 2/1981 Fed. Rep. of Germany .

*Primary Examiner*—Werner H. Schroeder
*Assistant Examiner*—Andrew M. Falik
*Attorney, Agent, or Firm*—McGlew and Tuttle

[57] ABSTRACT

A device for stopping the machine drive of a needle movable in cooperation with a rotary hook of a sewing, embroidering or tufting machine upon a thread breakage comprises a thread cutting mechanism which includes a thread catcher movable through the needle path and a switching mechanism which is connected to the drive for disconnecting it and which becomes effective upon a thread breakage. The device includes a movably mounted thread feeler carrier having a thread feeler which is adapted to be located between the needle and the rotary hook. The drive mechanism for actuating the thread catcher includes control cams which are engageable with lifting cams so as to project the feeler out of the path of motion of the thread between the needle and the rotary hook. The thread feeler is associated with a piezoelectric element and the deflection of the feeler by the thread produces a pulse which regulates the drive mechanism for the sewing machine and effects the stopping thereof when the threads are cut.

7 Claims, 3 Drawing Figures

Fig. 1
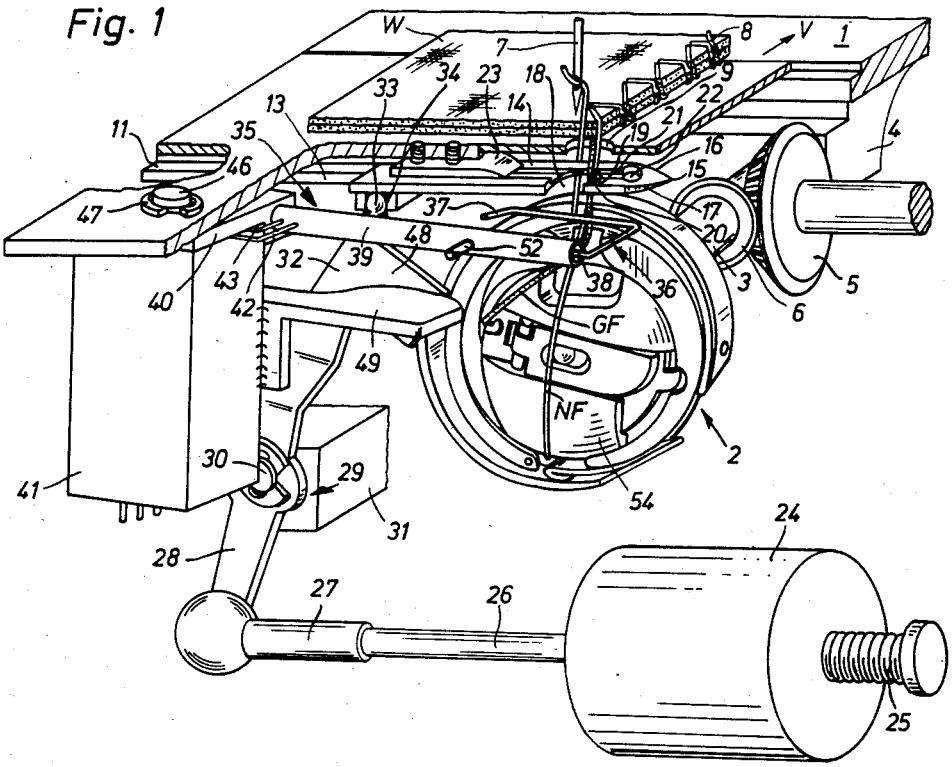
Fig. 2
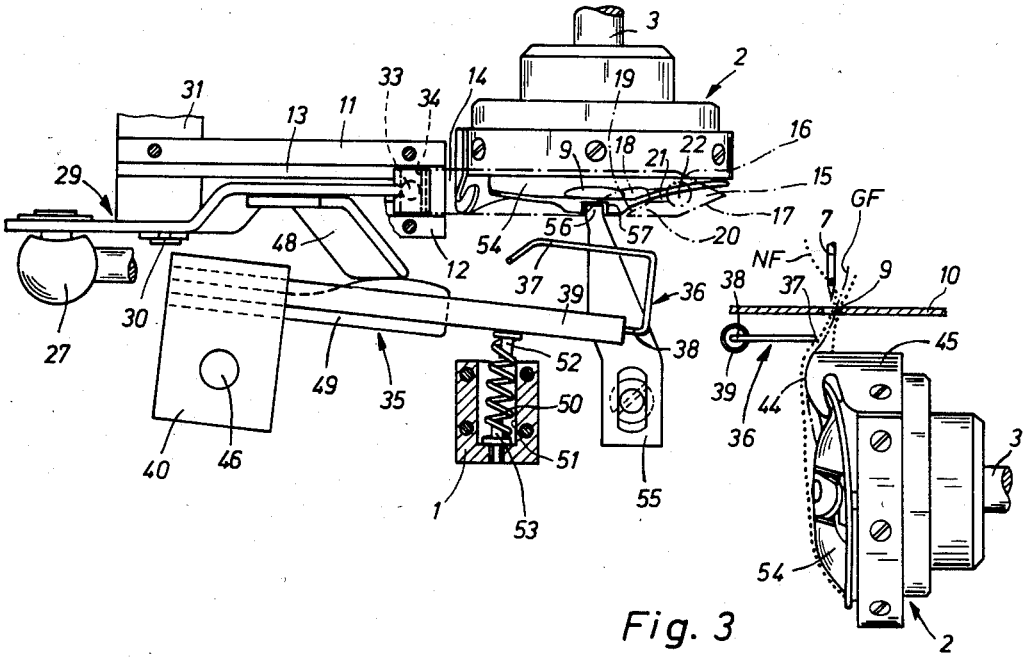
Fig. 3

UNDER BED THREAD TRIMMER WITH THREAD DETECTOR STOP MOTION

FIELD AND BACKGROUND OF THE INVENTION

This invention relates in general to sewing machines and in particular to a device for stopping a sewing, embroidering or tufting machine upon a thread breakage.

U.S. Pat. No. 4,429,651 discloses such a stopping device in which the piezoelectric element, serving as the thread feeler responsive to the thread deflection, is mounted by means of a soft rubber and a holder at a location which is particularly suitable for the detection. The thread feeler is near the needle hole at the underside of the needle plate and in the space through which, in machines equipped with a thread cutting mechanism, the thread catcher must move to separate the threads from each other and engage them, so that it necessarily would collide with the thread feeler. The mounting of the thread feeler in the close vicinity of the needle hole would prevent a feed catcher from moving into this space.

Since a thread cutting mechanism considerably improves the efficiency, and monitoring of thread breakages with sensitive stopping devices for quickly disconnecting the sewing machine and eliminates time consuming and costly refinishing operations, it is desirable to equip the machine with both a thread cutting mechanism and a reliably and quickly responding stopping device.

SUMMARY OF THE INVENTION

The present invention is directed to a stopping device which is so arranged and controlled that the thread sensing location can be maintained while a collision with the thread catcher is prevented.

In accordance with the invention, the device is provided for stopping the machine drive of a needle of a sewing or similar machine which moves in cooperation with a rotary hook and which includes a thread cutting mechanism which includes a thread catcher which is movable through the needle path by a thread catching drive mechanism which includes a switching mechanism connected to the drive of the needle and the hook for disconnecting upon breakage of the thread. The mechanism includes a movably mounted thread feeler carrier having a thread feeler which may be moved by the carrier to a position between the needle and the rotary hook so as to sense the presence of thread therebetween. The feeler includes an associated electrical mechanism which generates a pulse in response to the sensing of the thread and which is effective upon the breaking of the thread to stop the drive of the sewing machine.

In a preferred embodiment of the invention a piezoelectric element is actuated by the movement of the thread feeler as it is intermittently deflected by the rotary hook out of the center of the needle hole through which the needle reciprocates. For this purpose the thread feeler includes a small leg portion of a U-shaped wire bracket which extends in the path of motion of the threads while the other leg serves the purpose of actuating a piezoelectric element which is accommodated within a protective tube in the carrier. The wire bracket advantageously includes two leg portions of unequal lengths with the longer leg being used for actuating the piezoelectric element in the protective tube.

With the working motion of the thread catcher the stopping device is moved laterally out of the sensing position in the path of motion of the thread catcher, so that the two devices will operate without colliding with each other. The feeler includes a long leg portion of a feeler member which operates in a protective tube so that the sensitive piezoelectrical parts of the device will not be contaminated by the sewing dust. The force for actuating the piezoelectric element can be augmented.

Accordingly, it is an object of the invention to provide an improved means for sensing breakage of a thread in a sewing device or similar mechanism which can operate to sense the presence of thread between a movable needle and a rotary hook without interference with a thread catcher which is used for cutting the thread.

A further object of the invention is to provide a device for stopping the sewing of a machine and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view partly in section of the stitch forming tools, the thread cutting mechanism, and the stopping device of a sewing machine constructed in accordance with the invention;

FIG. 2 is a top plan view of a portion of the sewing machine of FIG. 1; and FIG. 3 is a side view of the rotary hook shown in FIG. 1 indicating how the threads are deflected.

DESCRIPTION OF THE PREFERRED EMBODIMENTS

Referring to the drawings in particular the invention embodied therein comprises a device for stopping of a needle 7 which is movable in cooperation with a rotary hook generally designated 2 of a machine for sewing, embroidering, tufting, etc. The drive mechanism of the machine moving the needle and rotating the hook is stopped when the electronic control contained in the carrier 41 which is actuated by a thread feeler 36 positioned to contact the threads between the needle and the hook and to actuate a switching mechanism in the carrier 41 upon thread breakage. In accordance with the invention the feeler 36 may be accurately positioned in respect to the thread without interfering with the operation of a thread catcher 14 which on occasion, as required engages the thread and moves it into association with a cutting knife 23.

FIG. 1 shows a bed plate 1 of a zig zag lock stitch sewing machine equipped with a rotary hook 2 positioned crosswise to the work feed direction V. Rotary hook 2 is secured to a shaft 3 which is mounted in an extension 4 of bed plate 1 and is driven through bevel gears 5 and 6 at a double speed relative to the armshaft of the machine. The rotary hook 2 cooperates with a thread guiding needle 7 which is driven from the arm shaft (not shown) and to which, in addition to its up and down motion through the needle hole 9 of the needle plate 10, an oscillatory movement is imparted, perpendicular to the work feed direction (arrow V in FIG. 1).

Screwed to the underside of the bed plate 1 are stepped-off guide strips 11, 12, (FIGS. 1 and 2) forming a guideway 13 for a thread catcher 14, extending crosswise of work feed direction V. Thread catcher 14 has a pointed tip 15 forming two side edges 16,17 for spreading the needle thread loop. In the zone of catcher tip 15, whose path of motion passes between the legs of the needle thread loop, thread catcher 14 is provided with a slot 18 whose one lateral boundary edge 19 forms with lateral edge 17 a barb 20 serving the purpose of withdrawing the threads to be cut.

On the top of thread catcher 14, a thread groove 21 is provided which extends parallel to the longitudinal axis of the catcher and terminates in the zone of tip 15 in a hole 22 extending therethrough. Thread catcher 14 cooperates with a cutting knife 23 which is secured to the underside of bed plate 1 above thread catcher 14 and whose edge portion is bent downwardly to apply against the top of the catcher. Thread catcher 14 is driven by a solenoid 24 whose tie rod 26 loaded by a spring 25 is connected through a ball-head rod 27 to one arm 28 of a two-armed lever 29. Two armed lever 29 is mounted for free pivoting on a stud 30 provided on an extension 31 of the underside of bed plate 1. The other arm of lever 29 is angled and provided on its end with a ball 33 engaging a groove 34 of thread catcher 14, and it imparts to the thread catcher 14 a lengthwise motion corresponding to the motion of the tie rod of the solenoid 24. In a manner known per se, solenoid 24 is connected in the control circuitry of the machine which, preferably, is designed to permit closing the solenoid circuit only with the needle in its lowermost position and to cause the armshaft of the machine to execute one further revolution after the closing of the solenoid circuit.

A stopping device 35 is provided for monitoring the threads and stopping the machine on a thread breakage. The device comprises a substantially U-shaped thread feeler 36 in the form of a wire bracket having unequally long legs 37,38, a protective tube 39, an intermediate plate 40, and a housing 41 accommodating an electronic switching mechanism.

The longer leg 38 of thread feeler 36 is received in protective tube 39. In the path of motion of leg 38 in tube 39, a piezoelectric element is mounted which is connected to the electronic switching mechanism in housing 41 through leads 42,43. The shorter leg 37 of feeler 36 senses the deflections of threads GF (bobbin thread) and NF (needle thread) which, with the machine in operation, are caused by the convex outer edge 44 of the hook plate 45 of the rotary hook 2.

Protective tube 39 is secured by one its end to intermediate plate 40 and is mounted for pivoting, along with the plate and housing 41, about a vertically extending pin 46 provided on bed plate 1. A locking washer 47 on pin 46 fixes the housing 41 axially.

To move stopping device 35, for the duration of a thread cutting operation, from its thread monitoring position in which leg 37 of thread feeler 36 extends in the path of motion of thread catcher 14, into an ineffective position in which thread catcher 14 and leg 37 cannot collide with each other, a control cam 48 is provided on the angled arm 32 of two-armed lever 29, and a lifting cam 49 welded to housing 41 is provided in the path of motion of control cam 48. Stopping device 35 in its entirety is loaded by a compression spring 50 which is accommodated in a recess 51 below bed plate 1 and centered on both its ends by means of studs 52, 53 of which one 52 is secured to protective tube 39 and the other 53 to the bottom of recess 51.

The bobbin case 54 of rotary hook 2 is secured against rotation with the hook by a fixed stop 55 having it free end 56 engaged with play in a groove 57 of casing 54.

The mechanism operates as follows:

With the sewing machine running, thread catcher 14 is retracted in its rest position, while stopping device 35 is in its thread monitoring position according to FIG. 3. In this position, leg 37 of thread feeler 36 extends in the path of motion of threads GF and NF which, as the rotary hook rotates, are intermittently deflected sidewards from the center of needle hole 9 by the convex outer edge 44 of hook plate 45. Since the bobbin thread and needle thread extend differently, bobbin thread GF is deflected at another angular position of the shaft 3 of the rotary hook than needle thread NF. Also, since the rotary hook performs two revolutions at every stitch and the loop is drawn already during the first revolution, leg 37 of thread feeler 36 is contacted by bobbin thread GF and needle thread NF in a certain sequence. This sequence, translated into a pulse sequence by the actuation of the piezoelectric element by leg 38 of thread feeler 36, is then used, through the electronic switching mechanism in housing 41, for controlling the machine drive. As long as bobbin thread GF and needle thread NF remain unbroken, the machine drive is not interrupted. As soon as one of the threads GF or NF breaks, however, the pulse sequence fed through thread feeler 36 and the piezoelectric element into the switching mechanism changes whereby the machine drive is instantly disconnected and the sewing machine stops. Upon the fault being removed, the sewing may continue.

At the end of the seam, by means of a stop motor known per se, the sewing machine is stopped with the needle in the lowermost position, and solenoid 24 is energized. This, at the same time, closes the motor circuit for the duration of a half revolution of the armshaft, so that needle 7, during the thread cutting operation, is brought from its lowermost position into its uppermost position and rotary hook 2, whose catching point is in front of the needle thread loop, executes a full revolution. After the hook point has penetrated into the needle thread loop and starts to enlarge it, solenoid 24, through two-armed lever 29, moves thread catcher 14 from the retracted rest position thereof through the path of motion of needle 7, thus to the right as viewed in FIGS. 1 and 2, into the catch position shown in these figures, so that tip 15 of the thread catcher penetrates into needle thread loop.

During this motion of thread catcher 14, control cam 48 of two-armed lever 29 strikes lifting cam 49 which is secured to housing 41, and pivots stopping device 35 against the action of compression spring 50 clockwise about stud 46, so that leg 37 of thread feeler 36 is moved laterally out of the path of motion of thread catcher 14, and thread feeler 36 and thread catcher 14 are prevented from colliding with each other.

During the motion of thread catcher 14, the leg leading to the thread supply of the needle thread loop contacts the side edge 16 of tip 15, while the leg leading to the work W of the needle thread loop contacts along with bobbin thread GF, the side edge 17 of catcher tip 15. During the further motion of the catcher and the hook, the needle thread loop is passed completely around bobbin casing 54 and thread catcher 14 penetrates into the needle thread loop until the leg leading to the work W of the needle thread loop along with bobbin thread GF is deflected by side edge 17 of catcher tip 15 against the boundary edge 19 of slot 18. With needle thread NF passed over bobbin case 54 falling off rotary hook 2, solenoid 24 is de-energized and spring 25 returns thread catcher 14 into the initial position thereof. During the return motion of thread catcher 14, barb 20 formed by side edge 17 and boundary edge 19 of slot 18 draws further thread from the bobbin and needle thread supplies, in an amount corresponding to this motion, and the legs leading to the work of bobbin and needle threads GF, NF come to extend in groove 21 of thread catcher 14 and, at the end of the retraction thereof, are cut by the fixed knife 23 applying thereto.

As thread catcher 14 is retracted, control cam 48 disengages from lifting cam 49 and stopping device 35 is moved by compression spring 50 back into its thread monitoring position shown in FIG. 3.

While specific embodiments of the invention have been shown and described in detail to illustrate the application of the principles of the invention, it will be understood that the invention may be embodied otherwise without departing from such principles.

What is claimed is:

1. A device for stopping the machine drive of a needle movable in cooperation with a rotary hook of a sewing, embroidering, or tufting machine upon a thread breakage, comprising a thread cutting mechanism including a thread catcher movable through the needle path, a switching mechanism connected to the drive for disconnecting the machine drive upon a thread breakage, movably mounted thread feeler carrier, a thread feeler provided on said carrier being locatable between the needle and the rotatable hook, a drive mechanism for actuating said thread catcher, and means associated with said drive mechanism for moving said thread feeler carrier with said thread feeler out of the path of the thread catcher during the operation thereof.

2. A device according to claim 1, including a piezoelectric element with feeler including a member associated with said piezoelectric element and which is deflected by the thread to actuate the element for disconnecting the drive, said thread feeler comprising a member in the form of a U-shaped wire bracket having one leg extending in the path of motion of the thread and including a tube engaged around said other leg having a piezoelectric element which is actuated by movement of said other leg.

3. A device according to claim 1, wherein said thread feeler includes a wire bracket member having an elongated leg, a straight transverse leg and a shorter leg with an offset end engageable by the threads and including a piezoelectric tube engaged around said longer leg and carried by said thread feeler carrier.

4. A device for stopping a mechanical drive of a needle movable in cooperation with the rotary hook of a sewing, embroidering or tufting machine, comprising drive means for driving the rotary hook and said needle in timed relationship, a cutting knife, a thread cutting mechanism for engaging the thread for cutting the thread connected to said drive means including a thread catcher movable backwardly and forwardly through the needle path and the cutting knife, thread catcher drive means connected to said thread catcher to move it backwardly and forwardly, a thread feeler pivotally mounted alongside said thread catcher and having the thread feeler member positionable in an active position to engage the thread at the location of the thread between the needle and the rotary hook and engageable with the thread during sewing to thereby sense when the thread is broken, and control means associated with said feeler and connected to said drive to effect the stoppage of said drive when the thread is cut and a cam associated with said thread catcher drive means for moving said feeler out of a position in which it contacts the thread during operation of said thread catcher.

5. A device according to claim 4, wherein said thread catcher comprises a plate slidably mounted between said needle and said rotary hook and having a forward edge for spreading the thread and an intermediate slot formed in a side edge for engaging the thread to advance it in a direction toward said cutting knife, said feeler member comprising a U-shaped bracket having one leg portion engageable with the thread and an opposite leg portion, said control means including a piezoelectric member associated with said second leg portion and connected to the drive for shutting down said drive when no thread is sensed.

6. A device according to claim 5, wherein when the thread is contacted, said leg portion moves in respect to said piezoelectric tube so as to generate a pulse which continues the drive or which when the thread is broken effects the discontinuance of the drive.

7. A device according to claim 5, wherein said cam includes a control cam carried by said feeler, said thread catcher drive means including a two-armed lever having a lift cam associated therewith for lifting said control cam to shift said feeler.

* * * * *